US011969059B2

(12) United States Patent
Jessup et al.

(10) Patent No.: US 11,969,059 B2
(45) Date of Patent: Apr. 30, 2024

(54) ELECTRICALLY RELEASABLE BUCKLE ASSEMBLY FOR A MOTOR VEHICLE RESTRAINT

(71) Applicant: INDIANA MILLS & MANUFACTURING, INC., Westfield, IN (US)

(72) Inventors: Chris P. Jessup, Sheridan, IN (US); Nathan Beadle, Carmel, IN (US); Brian N. Coffman, Gurley, AL (US); Wei X. Zhang, Jiangsu (CN)

(73) Assignee: INDIANA MILLS & MANUFACTURING, INC., Westfield, IN (US)

( * ) Notice: Subject to any disclaimer, the term of this patent is extended or adjusted under 35 U.S.C. 154(b) by 72 days.

(21) Appl. No.: 17/635,919

(22) PCT Filed: Aug. 25, 2020

(86) PCT No.: PCT/CN2020/111081
§ 371 (c)(1),
(2) Date: Feb. 16, 2022

(87) PCT Pub. No.: WO2021/037024
PCT Pub. Date: Mar. 4, 2021

(65) Prior Publication Data

US 2022/0338599 A1 Oct. 27, 2022

Related U.S. Application Data

(60) Provisional application No. 62/891,483, filed on Aug. 26, 2019.

(51) Int. Cl.
*B60R 22/02* (2006.01)
*A44B 11/25* (2006.01)

(52) U.S. Cl.
CPC ..... *A44B 11/2569* (2013.01); *A44B 11/2523* (2013.01)

(58) Field of Classification Search
CPC ..... B60R 2022/1806; B60R 22/18; A44B 11/2523; A44B 11/2569
See application file for complete search history.

(56) References Cited

U.S. PATENT DOCUMENTS

2010/0066151 A1* 3/2010 Usoro ..... B60R 22/03 297/481
2010/0176581 A1* 7/2010 Usoro ..... B60R 22/03 280/801.1

FOREIGN PATENT DOCUMENTS

CN 101683838 A 3/2010
CN 101817333 A 9/2010
(Continued)

OTHER PUBLICATIONS

PCT International Search Report and Written Opinion completed by the ISA/CN dated Nov. 10, 2020 and issued in connection with PCT/CN2020/111081.

*Primary Examiner* — Robert Sandy
*Assistant Examiner* — Michael S Lee
(74) *Attorney, Agent, or Firm* — Barnes & Thornburg LLP

(57) ABSTRACT

An electrically releasable buckle assembly (12) for a motor vehicle restraint (10) may include latch components (18) configured to releasably engage a tongue member (14B) of the motor vehicle restraint (10), a release button (16) operatively coupled to the latch components (18), the release button (16) having a latched position in which the latching components engage the tongue member (14B) and a release position in which the latch components (18) release the tongue member (14B), an electrical energy source (32), at least one shape memory alloy component (26) operatively
(Continued)

coupled to the release button (16), the at least one shape memory alloy component (26) responsive to heating thereof by electrical energy supplied by the source (32) to a temperature at or above a transition temperature thereof to move the release button (16) from the latched position to the release position, and means (34) for selectively supplying electrical energy from the electrical energy source (32) to the at least one shape memory alloy component (26).

9 Claims, 12 Drawing Sheets

(56) References Cited

FOREIGN PATENT DOCUMENTS

| | | | |
|---|---|---|---|
| CN | 105539354 | A | 5/2016 |
| CN | 205273404 | U | 6/2016 |
| DE | 102011100362 | A1 | 11/2012 |
| DE | 102014008054 | A1 | 12/2014 |
| JP | 2007145053 | A | 6/2007 |
| KR | 910006846 | B1 | 9/1991 |

* cited by examiner

ELECTRICALLY RELEASABLE BUCKLE ASSEMBLY FOR A MOTOR VEHICLE RESTRAINT

CROSS-REFERENCE TO RELATED APPLICATIONS

This patent application is a U.S. national stage entry of PCT Application No. PCT/CN2020/111081, filed Aug. 25, 2020, which claims the benefit of and priority to U.S. Provisional Patent Application No. 62/891,483, filed Aug. 26, 2019, the disclosures of which are expressly incorporated herein by reference in their entireties.

TECHNICAL FIELD

The present disclosure relates generally to restraint systems for motor vehicles, and more specifically to restraint systems having electrically controllable buckle arrangements.

BACKGROUND

Conventional restraint systems for motor vehicles may typically include a tongue and buckle arrangement, each coupled to one or more respective restraint webs, in which the tongue and buckle assemblies are releasably engageable with one another. Some such conventional restraint systems may include electrically controllable buckle arrangements.

SUMMARY

The present disclosure may comprise one or more of the features recited in the attached claims, and/or one or more of the following features and combinations thereof. In one aspect, an electrically releasable buckle assembly for a motor vehicle restrain may comprise latch components configured to releasably engage a tongue member of the motor vehicle restraint, a release button operatively coupled to the latch components, the release button having a latched position in which the latching components engage the tongue member and a release position in which the latch components release the tongue member, an electrical energy source, at least one shape memory alloy component operatively coupled to the release button, the at least one shape memory alloy component responsive to heating thereof by electrical energy supplied by the source to a temperature at or above a transition temperature thereof to move the release button from the latched position to the release position, and means for selectively supplying electrical energy from the electrical energy source to the at least one shape memory alloy component.

DESCRIPTION OF THE ILLUSTRATIVE EMBODIMENTS

For the purposes of promoting an understanding of the principles of this disclosure, reference will now be made to a number of illustrative embodiments shown in the attached drawings and specific language will be used to describe the same.

Figure 1:
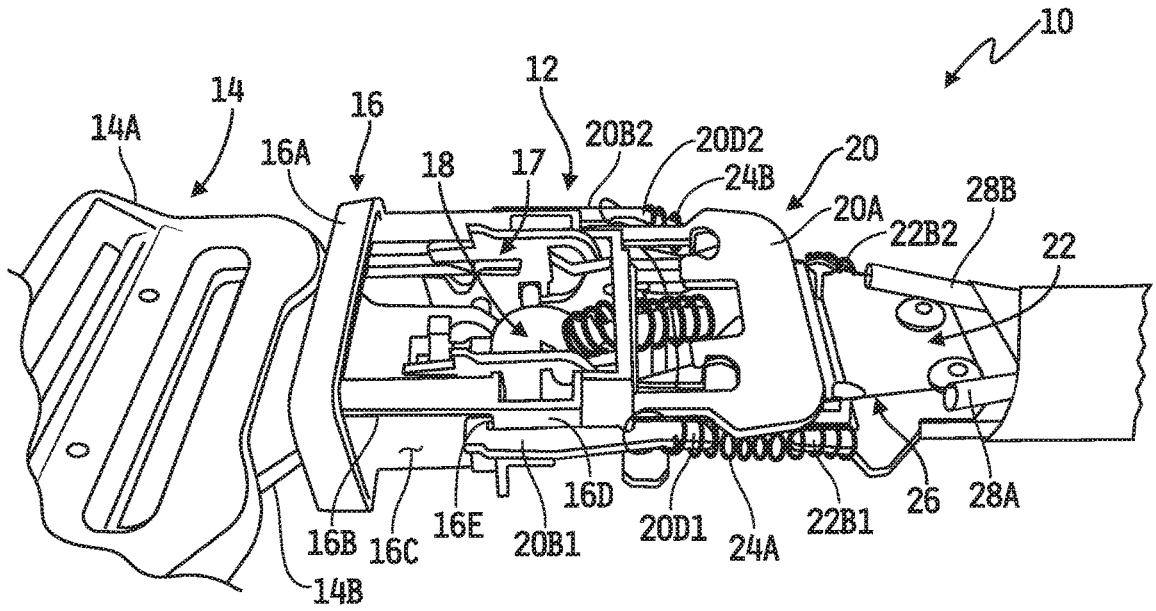
FIG. 1 is a perspective view of an embodiment of a motor vehicle restraint system including an embodiment of a portion of an electrically releasable buckle assembly shown in a latched state with the buckle assembly engaging a conventional tongue assembly.
Figure 2:
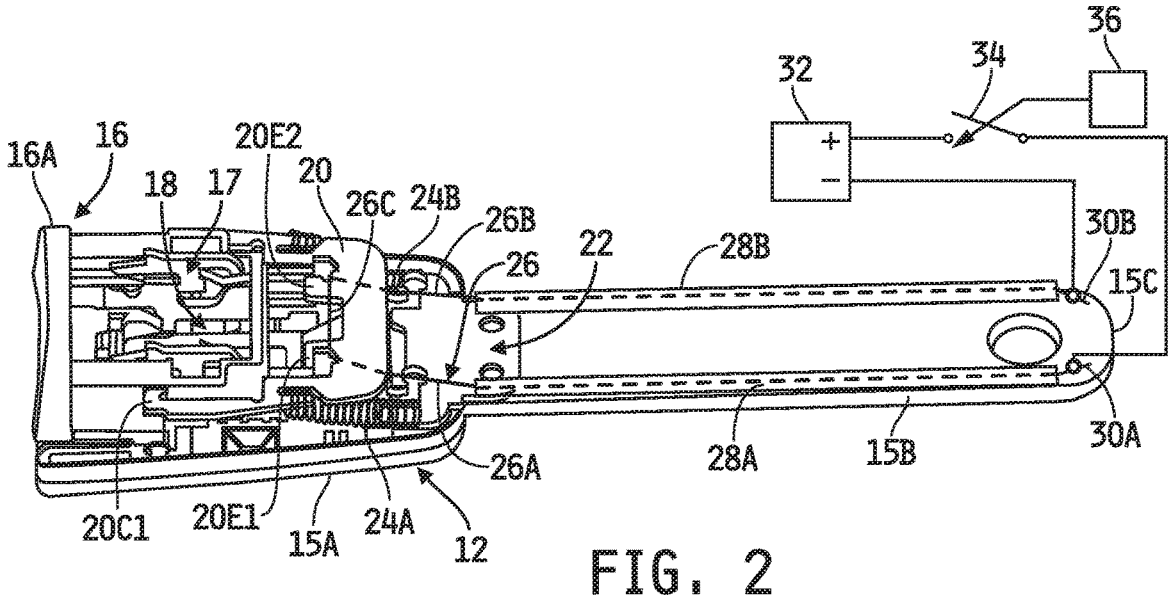
FIG. 2 is a perspective view of the electrically releasable buckle assembly of FIG. 1 shown in the latched state and illustrating additional components thereof.

This disclosure relates to devices and techniques for selectively releasing a buckle assembly from a tongue member of a motor vehicle restraint by selectively supplying electrical energy to a shape memory alloy component coupled to a release button of the buckle assembly. Referring to FIGS. 1 and 2, for example, an embodiment is shown of a motor vehicle restraint 10 including an embodiment of an electrically releasable buckle assembly 12 which is shown in FIGS. 1 and 2 in a latched state with the buckle assembly 12 engaging a conventional tongue assembly 14.

In the illustrated embodiment, the buckle assembly 12 includes a conventional release button 16 operatively coupled to a frame 17 of the buckle assembly 12. The release button 16 is movable relative to the frame 17 between a latched position, in which the buckle assembly 12 is engaged with the tongue assembly 14, and a release position which releases the tongue assembly 14 from the buckle assembly in a conventional manner. In the illustrated embodiment, the release button 16 is linearly slidable fore and aft relative to the frame 17 in a conventional manner between the latched and release positions thereof, although in alternate embodiments the release button 16 may slide non-linearly relative to the frame 17 and/or move or pivot in directions other than that illustrated in FIGS. 3-4. The tongue assembly 14 is illustratively conventional and includes a web engaging body 14A coupled to a rigid tongue member 14B sized and configured to be received within a slot defined through a font nose piece 16A of the release button 16 in a conventional manner as illustrated by example in FIG. 1.

The buckle assembly 12 further illustratively includes conventional tongue latching and release components 18 operatively mounted to the frame 17 and together configured in a conventional manner to cause the tongue to be secured to the buckle assembly 12 in the latched state and to be released from, and in some embodiments expelled from, the buckle assembly 12 in the release state. Identical opposite sides 16B of the release button 16 extend rearwardly away from the nose piece 16A, and each side 16B illustratively defines a channel 16C between a rear edge of the nose piece 16A and a front edge 16E of a rear wall 16D which is spaced apart from the nose piece 16A by the channel 16C and which projects laterally away from the side 16B of the release button 16.

Figure 3:
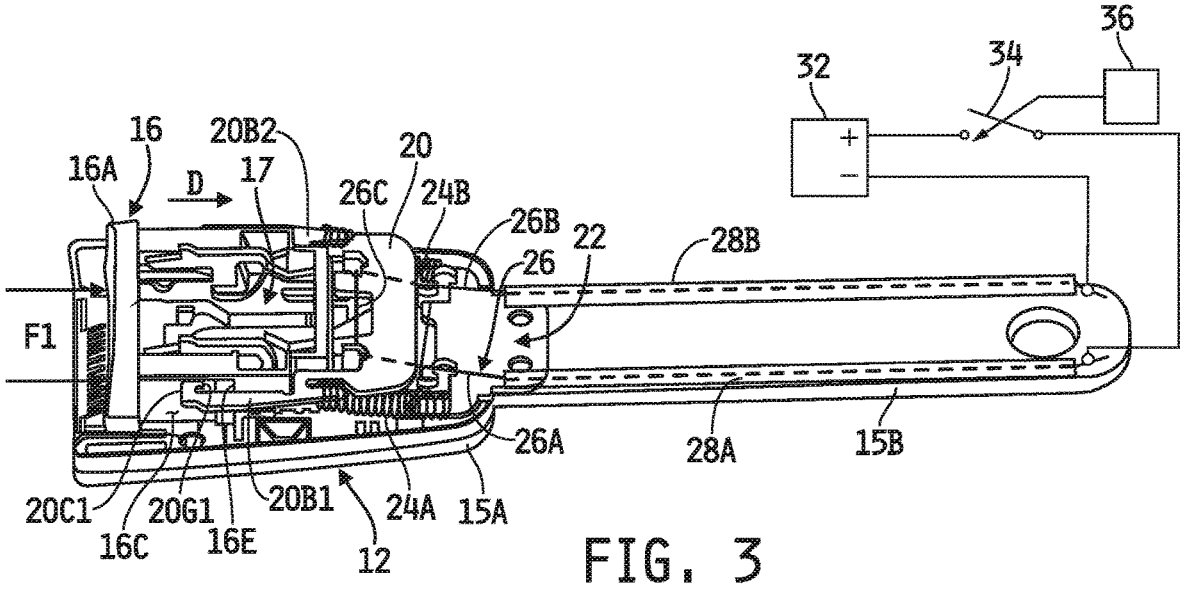
FIG. 3 is a perspective view similar to FIG. 2 and showing the buckle assembly manually actuated, via manual actuation of the release button, from the latched state of FIG. 2 to an unlatched or release state in which the tongue assembly is released therefrom.
Figure 4:
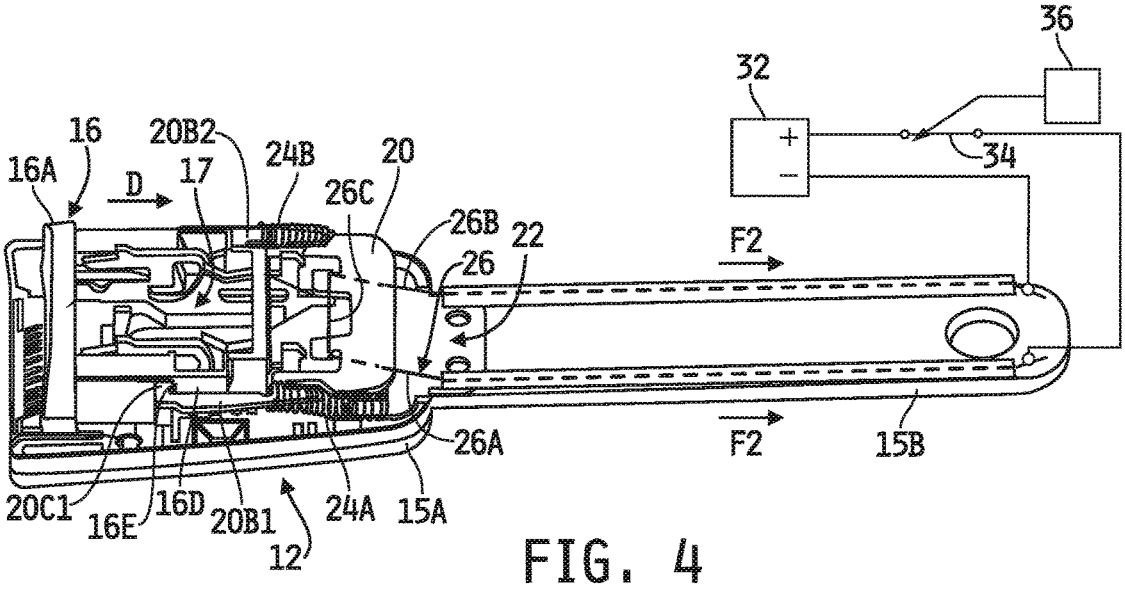
FIG. 4 is a perspective view similar to FIG. 2 and showing the buckle assembly electrically actuated, via electrical actuation of a shape memory alloy member operatively coupled to the release button, from the latched state of FIG. 2 to the unlatched or release state.

In one embodiment, the release button 16 is formed of a conventional rigid plastic material and the frame 17 is formed of one or more conventional metals and/or metal composites, although in alternate embodiments the release button 16 and/or the frame 17 may be formed of other conventional materials. In some embodiments, the buckle assembly 12 may be housed in a protective cover or housing. In some such embodiments, the protective cover or housing may include at least two portions which are configured to couple to one another to encase the assembly 12, a partial example of which is illustrated in FIGS. 2-4 which show a rigid or semi-rigid base portion 15A of a two-piece housing in which the buckle assembly 12 is received. Although not shown in the attached figures, such a housing will illustratively include a top portion configured to be disposed over the exposed portion of the assembly 12 illustrated in FIGS. 2-4 and to couple to the base portion 15A of the housing to form a complete housing disposed about the assembly 12 in a conventional manner. In any case, in the illustrated embodiment an elongated rigid base extension or member 15B is coupled to the base portion 15A and extends rearwardly therefrom, as illustrated by example in FIG. 2. In some embodiments, the base extension 15B is formed of a rigid plastic material, although in alternate embodiments the base extension 15B may be formed of one or more alternate or additional materials.

A buckle release actuating plate 20 is movably coupled to the release button 16 and, in the illustrated embodiment, movement of the buckle release plate 20 relative to the release button 16 is illustratively controlled by a shape memory alloy component 26 coupled to the buckle release actuating plate 20. As will be described in greater detail below with reference to FIGS. 2-4, the shape memory alloy component 26 is illustratively responsive to electrical energization thereof to draw the combination of the buckle release actuating plate 20 and the buckle release button 16 rearwardly (relative to the frame 17, base 15A and base extension 15B) and into the release position of the buckle release button 16 to decouple or disengage, and in some embodiments eject, the tongue 14B of the tongue assembly 14 from the buckle assembly 12. The shape memory alloy component 26 is further illustratively responsive to electrical denergization thereof, or at least to a reduction in the magnitude of electrical energy supplied thereto, to allow the combination of the buckle release actuating plate 20 and the buckle release button 16 to move forwardly and return to the latched position of the buckle release button 16. In the illustrated embodiment, a base plate 22 is mounted and affixed to the base extension 15B (and/or to the housing base 15A) rearwardly of, and adjacent to, the buckle release actuating plate 20, and biasing members 24A, 24B, e.g., coil springs or other suitable biasing members, extend between the base plate 22 and the buckle release actuating plate 20. In the illustrated embodiment, the biasing members 24A, 24B exert a biasing force between the fixed-position base plate 22 and the buckle release actuating plate 20, and in this embodiment the biasing force of the biasing members 24A, 24B normally biases, i.e., in the absence of electrical energization of the shape memory alloy component 26, the combination of the buckle release actuating plate 20 and the buckle release button 16 forwardly and into the latched position of the buckle release button 16. Following electrical denergization of the shape memory alloy component 26 as described above, the biasing members 24A, 24B also move the combination of the buckle release actuating plate 20 and the buckle release button 16 forwardly to return the combination to the latched position of the buckle release button 16.

The buckle release button 16 is further illustratively responsive, in the absence of electrical energization of the shape memory alloy component 26, to manual force applied thereto in the rearward direction to move the buckle release button 16 rearwardly and into the release position of the buckle release button 16, without also moving the buckle release actuating plate 20, to decouple or disengage, and in some embodiments eject, the tongue 14B of the tongue assembly 14 from the buckle assembly 12. In this last scenario, the buckle release button 16 moves rearwardly relative to the frame 17, base 15A, base extension 15B and the buckle release actuating plate 20 (with the position of the buckle release actuating plate 20 relative to the frame 17, base 15A and base extension 15B remaining relatively fixed).

Figure 5:
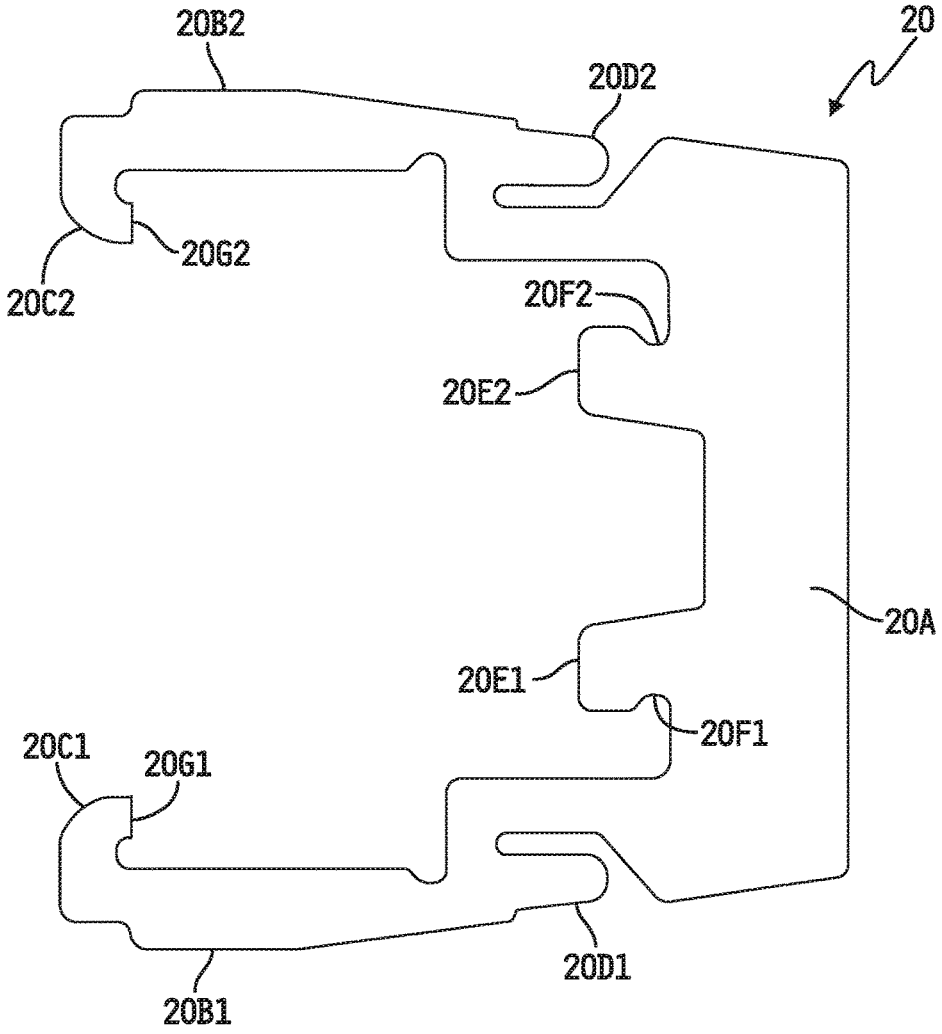
FIG. 5 is a top plan view of an embodiment of the buckle release actuating plate illustrated in FIGS. 1-4.

Referring now to FIG. 5, a top plan view is shown of the buckle release actuating plate 20 illustrated in FIGS. 1-4. In the illustrated embodiment, the plate 20 is a substantially flat structure having a generally rectangular body 20A from which release button engaging arms 20B1 and 20B2 extend forwardly on either side thereof. Inwardly-facing hooks 20C1, 20C2 are defined at the forward, free ends of the arms 20B1, 20B2, and rearwardly-facing biasing member engaging protrusions 20D2, 20D2 are defined at the rearward ends of the arms 20B1, 20B2 adjacent to the junctions of the arms 20B1, 20B2 and the body 20A. Inwardly of the arms 20B1, 20B2, forwardly-facing protrusions 20E1, 20E2 extend from the body 20A with the protrusions 20E1, 20E2 laterally spaced apart from one another. Channels 20F1, 20F2 are formed in the outwardly-facing lateral surfaces of the protrusions 20E1, 20E2. The free ends of the hooks 20C1, 20C2 illustratively define planar surfaces 20G1, 20G1 each facing rearwardly toward the body 20A.

Figure 6:
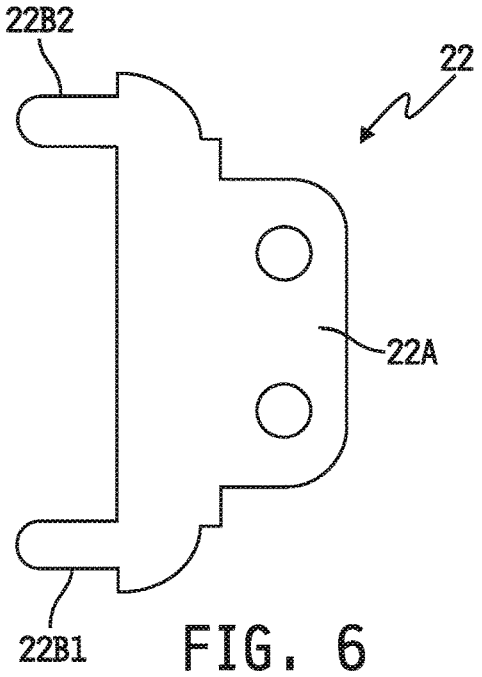
FIG. 6 is a top plan view of an embodiment of the base plate illustrated in FIGS. 1-4.

Referring now to FIG. 6, a top plan view is shown of the base plate 22 illustrated in FIGS. 1-4. In the illustrated embodiment, the base plate 22 is a substantially flat structure having a generally rectangular body 22A from which biasing member engaging protrusions 22B1 and 22B2 extend forwardly on either side thereof. The body 22A further illustratively defines openings 22C therethrough each sized to receive a conventional fixation member, e.g., screw, for mounting and affixing the base plate 22 to the base extension 15B and/or to the housing base 15A.

Referring again to FIGS. 1 and 2, each of which show the buckle assembly 12 with the buckle release button 16 in the forward, latched position thereof, the hooks 20C1, 20C2 of the buckle release actuating plate 20 are positioned within the channels 16C defined laterally into the sides 16B of the button 16, and the biasing members 24A, 24B are mounted to and between the protrusions 20D1, 22B1 and 20D2, 22B2 of the plates 20 and 22 respectively. The biasing members 24A, 24B bias the buckle release actuating plate 20 forwardly away from the base plate 22 which is fixed to the housing base 15A and/or base extension 15B. In the forward, latched position of the buckle release button 16, the rearwardly-facing planar surfaces 20G1, 20G2 of the hooks 20C1, 20C2 of the buckle release actuating plate 20 illustratively abut, i.e., contact, the front edges 16E of the rear walls 16D of the buckle release button sides 16B as illustrated by example in FIGS. 1 and 2.

In the illustrated embodiment, the shape memory alloy component 26 is provided in the form of a single length of shape memory alloy wire or cable affixed at both ends 30A, 30B thereof to the base extension 15B at or near a free end 15C of the base extension 15B, i.e., opposite that to which the base plate 22 is affixed (see, e.g., FIG. 2). The ends 30A, 30B are illustratively spaced apart laterally from one another such that two respective portions 26A, 26B of the shape memory alloy wire or cable 26 extend along and adjacent to respective sides of the base extension 15B. A central portion 26C of the wire or cable 26 between the two respective side portions 26A, 26B is looped about the forwardly-facing protrusions 20E1, 20E2 extending from the body 20A of the buckle release actuating plate 20. In the illustrated embodiment, the central portion 26C of the wire or cable 26 engages the channels 20F1, 20F2 of the protrusions 20E1, 20E2 for the purpose of maintaining operative contact between the wire or cable 26 and the buckle release actuating plate 20. In some alternate embodiments, the buckle release actuating plate 20 and/or the portion 26C of the wire or cable 26 may be configured such that the portion 26C of the wire or cable 26 engages the plate 20 at one or more other locations and/or in a manner differently than shown and described. In any case, in some embodiments, one or more insulating (i.e., electrical and/or thermal insulating) sheaths may be provided about one or more respective portions of the shape memory alloy wire or cable 26, and in the illustrated embodiment two such sheaths 28A, 28B are provided about the respective side portions 26A, 26B of the shape memory alloy wire or cable 26, with the portion 26A of the wire or cable 26 extending through the sheath 28A and with the portion 26B extending through the sheath 28B. In the illustrated embodiment, the sheaths 28A, 28B each terminate at or on the plate 22 at one end thereof, and adjacent to the ends 30A, 30B of the respective wire or cable portions 26A, 26B at the opposite ends of the sheaths 28A, 28B. In some alternate embodiments, the sheath 28A and/or the sheath 28B may be longer or shorter in contrast to the embodiment illustrated in FIG. 2.

A source 32 of electrical energy is electrically connected through a switch 34 to the two side portions 26A, 26B of the shape memory alloy wire or cable 26, e.g., at or near the ends 30A, 30B thereof. In some embodiments, the switch 34 may be a manually activated switch, although in other embodiments the switch 34 may alternatively or additionally be electrically controlled by a control circuit 36. In the latter case, the switch 34 may be separate from or part of, i.e., integral with, the control circuit 36. In some embodiments, the source 32 of electrical energy may be a conventional DC or AC voltage and/or current source. In any case, the shape memory alloy wire or cable 26 is illustratively formed of a material which causes its length to contract or shrink to a shorter length above a transition temperature, and which returns to the pre-contracted or pre-shrunken length below the transition temperature. In one embodiment, for example, the shape memory alloy wire or cable 26 is formed of a nickel and titanium alloy commercially available as Nitinol® wire, although other material formations of the shape memory alloy wire or cable 26 are contemplated by this disclosure.

In any case, the temperature of the shape memory alloy wire or cable 26, and thus the length thereof, is controlled via selective application thereto of electrical energy supplied by the source 32 of electrical energy, i.e., via control of the switch 34. The shape memory alloy wire or cable 26 illustratively has a length L1 below its transition temperature and contracts or shrinks to a length L2 above its transition temperature, where L1>L2. Illustratively, the amount of shrinkage that the shape memory alloy wire or cable 26 will undergo when the temperature of the wire or cable 26 reaches and exceeds its transition temperature is a percentage of its total length, wherein this percentage is generally a function of the particular material composition and/or dimensions. In one example formulation of Nitinol®, this percentage is in the range of 5-10% of the total length of the wire or cable 26, although it will be understood that shrinkage/elongation percentages below or above this range are intended to fall within the scope of this disclosure.

In the example illustrated in FIGS. 1 and 2, the release button 16 is in its latched position, and the switch 34 is open such that the temperature of the shape memory alloy wire or cable 26 is below its transition temperature, and thus at its elongated length L1, such that the biasing members 24A, 24B bias the buckle release actuating plate 20 forwardly with the rearwardly-facing planar surfaces 20G1, 20G2 of the hooks 20C1, 20C2 of the buckle release actuating plate 20 illustratively abutting the front edges 16E of the rear walls 16D of the buckle release button sides 16B as described above. In one example embodiment using Nitinol® as the shape memory alloy wire or cable 26, which should not be considered to be limiting in any way, the difference between the lengths L1 and L2, which is the amount of shrinkage or contraction above the transition temperature T, is approximately 6 millimeters, the transition temperature T is approximately 180 degrees F., and the source 32 of electrical energy is configured to supply approximately 0.8 amperes at approximately 2.8 volts. Those skilled in the art will recognize that other material compositions and/or configurations/length of the shape memory alloy component 26 may alternatively be implemented, the amount of shrinkage or contraction of any material composition and/or configuration of the shape memory alloy component 26 may alternatively be greater or lesser than 6 millimeters, the transition temperature T of any material composition and/or configuration of the shape memory alloy component 26 may alternatively be greater or lesser than 180 degrees F., and/or the source 32 of electrical energy may alternatively be configured to produce current greater or lesser than 0.8 amperes at any desired voltage magnitude.

In the example illustrated in FIG. 3, the switch 34 is open such that the temperature of the shape memory alloy wire or cable 26 is maintained below its transition temperature and thus at its length L1, such that the biasing members 24A, 24B bias the buckle release actuating plate 20 fully forwardly as described above with respect to FIGS. 1 and 2. In this example, however, a manual force F1 is applied to the front face of the release button 16 in the rearward direction D, sufficient to cause the release button 16 to travel rearwardly, relative to the frame 17, the base 15A, the base extension 15B and the buckle release actuating plate 20, to its release position described above. It will be noted that throughout such rearward movement of the release button 16 while the temperature of the shape memory alloy wire or cable 26 is below its transition temperature, the position of the buckle release actuating plate 20 remains substantially fixed relative to the frame 17, base 15A and base extension 15B due to the forward bias applied between the plates 20, 22 by the biasing members 24A, 24B. Accordingly, as the release button 16 travels rearwardly, the front edges 16E of the rear walls 16D of the buckle release button sides 16B are drawn away from the rearwardly-facing planar surfaces 20G1, 20G2 of the hooks 20C1, 20C2 of the buckle release actuating plate 20, as illustrated by example in FIG. 3.

In the example illustrated in FIG. 4, the switch 34 is closed, e.g., manually or via the control circuit 36, such that electrical energy is supplied by the source 32 to the shape memory alloy wire or cable 26. As electrical current flows from the source 32 through the shape memory alloy wire or cable 26, the temperature of the wire or cable 26 increases proportionally thereto. The magnitude of the electrical current is illustratively selected to cause the temperature of the shape memory alloy wire or cable 26 to increase above its transition temperature within a selected time period T of closure of the switch 34. In some embodiments, one or more resistors may be suitably connected between the source 32 and the wire or cable 26 to achieve and/or limit the magnitude of such electrical current. In any case, when the temperature of the wire or cable 26 reaches and/or exceeds its transition temperature, the length of the wire or cable 26 shrinks from L1 to L2. With the free ends 30A, 30B of the wire or cable 26 affixed to the base extension 15B and the center section 26C coupled to the buckle release actuating plate 20 as illustrated in FIGS. 2-4 and described above, such contraction or shrinking of the wire or cable 26 exerts a rearward force F2 on the buckle release actuating plate 20 in the direction D sufficient to cause the combination of the release actuating plate 20 and the release button 16 to travel rearwardly, relative to the frame 17, the base 15A and the base extension 15B to its release position described above. It will be noted that throughout such rearward movement of the release actuating plate 20 due to contraction or shrinking of the shape memory alloy wire or cable 26, the rearwardly-facing planar surfaces 20G1, 20G2 of the hooks 20C1, 20C2 of the buckle release actuating plate 20 act against the front edges 16E of the rear walls 16D of the buckle release button sides 16B to draw the buckle release button 16 rearwardly to the release position thereof against the biasing forces of the biasing members 24A, 24B relative to the base plate 22 as illustrated by example in FIG. 4. Upon manual or electronic control of the switch 34 to the open position thereof, the temperature of the shape memory alloy wire or cable 26 will decrease and eventually fall below its transition temperature and elongate back to its length L1. When this occurs, the biasing force of the biasing members 24A, 24B acting against the fixed-position base plate 22 will force the buckle release actuating plate 20 forwardly, and the buckle release button 16 will then return, e.g., under control of the conventional latching components 18, to its latched position.

It will be understood that only one example embodiment of the buckle assembly 12 illustrated in the attached figures has been described herein, and that other configurations of the shape memory alloy component 26 are intended to fall within the scope of this disclosure. As one non-limiting example, the shape memory alloy component 26 may alternatively or additionally be provided in the form of one or more loops which may form a more compact configuration. In some such embodiments, the one or more loops may form a coiled member, e.g., spring, which exerts a biasing forward biasing force against the buckle release button 16 at temperatures below the transition temperature thereof but which draws the buckle release mechanism 16 rearwardly to its release position at temperatures above the transition temperature thereof. In some such embodiments, the buckle release actuating plate 20 may be included, and in other such embodiments the buckle release actuating plate 20 may be omitted. Other configurations of the shape memory alloy component 26 and/or of its operative coupling to the buckle release button 16 will occur to those skilled in the art, and it will be understood that any such other configurations are intended to fall within the scope of this disclosure.

Figure 7:
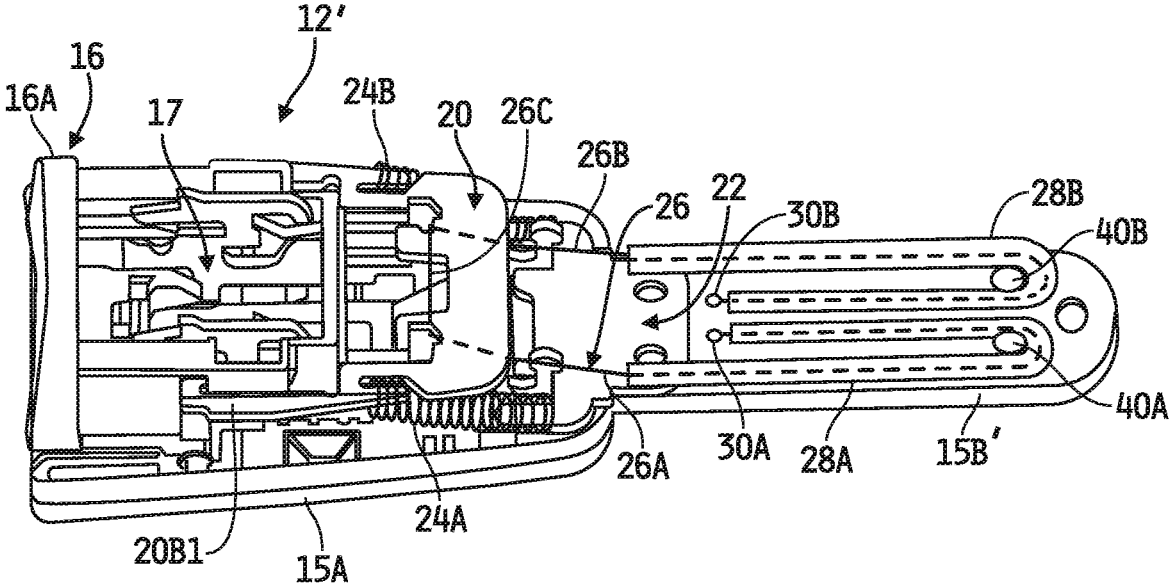
FIG. 7 is a perspective view of another embodiment of an electrically releasable buckle assembly for a motor vehicle restraint assembly, with the buckle assembly shown in the latched state.

Referring now to FIG. 7, another embodiment is shown of an electrically releasable buckle assembly 12' for a motor vehicle restraint assembly, with the buckle assembly 12' shown in the latched state described above. The buckle assembly 12' is identical in many respects to the buckle assembly 12 illustrated in FIGS. 1-6 and described above, and like numbers are therefore used to identify like components. The buckle assembly 12' illustratively differs from the buckle assembly 12 in that the base extension 15B' is substantially shorter than the base extension 15B and includes a pair of turning posts 40A, 40B mounted thereto adjacent to the free end of the base extension 15B'. In this embodiment, the wire or cable portion 26A, e.g., with the sheath 28A disposed thereabout, is wrapped around the post 40A and routed back toward the base plate 22 such that the free end 30A of the wire or cable portion 26A is fixed to the base extension 15B' adjacent to, but spaced apart from, the base plate 22. Likewise, the wire or cable portion 26B, e.g., with the sheath 28B disposed thereabout, is wrapped around the post 40B and routed back toward the base plate 22 such that the free end 30B of the wire or cable portion 26B is fixed to the base extension 15B' adjacent to, but spaced apart from, the base plate 22.

Figure 8:
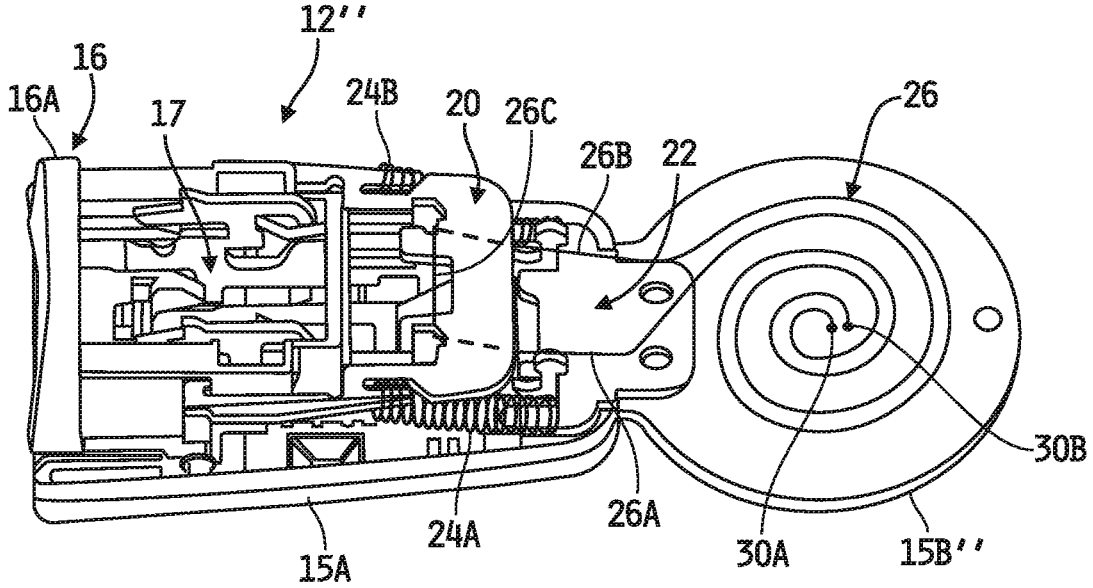
FIG. 8 is a perspective view of yet another embodiment of an electrically releasable buckle assembly for a motor vehicle restraint system, with the buckle assembly shown in the latched state.

Referring now to FIG. 8, yet another embodiment is shown of an electrically releasable buckle assembly 12" for a motor vehicle restraint assembly, with the buckle assembly 12" shown in the latched state described above. The buckle assembly 12" is identical in many respects to the buckle assembly 12 illustrated in FIGS. 1-6 and described above and with the buckle assembly 12' illustrated in FIG. 7 and described above, and like numbers are therefore used to identify like components. The buckle assembly 12" illustratively differs from the buckle assembly 12' in that the base extension 15B" is reshaped, e.g., in the form of a circle, oval or other convenient structure, to accommodate curling or coiling of the wire or cable portions 26A, 26B in a spiral pattern such that the free ends 30A, 30B are fixed to the base extension 15B" approximately in the middle portion of the base extension 15B", although in alternate embodiments the free ends 30A, 30B may be fixed elsewhere on or along the base extension 15B".

Figure 9:
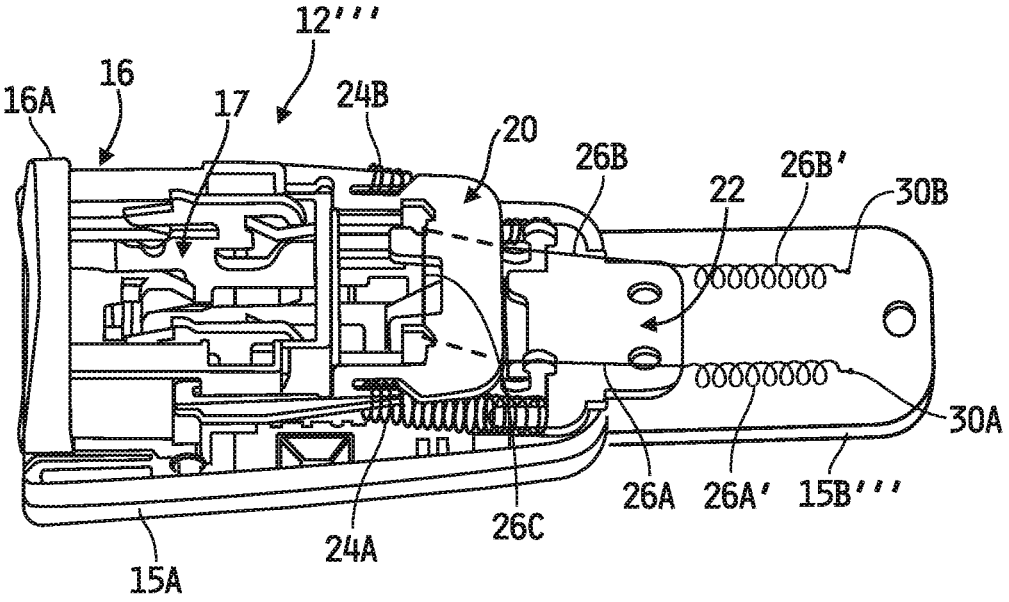
FIG. 9 is a perspective view of still another embodiment of an electrically releasable buckle assembly for a motor vehicle restraint system, with the buckle assembly shown in the latched state.

Referring now to FIG. 9, still another embodiment is shown of an electrically releasable buckle assembly 12''' for a motor vehicle restraint assembly, with the buckle assembly 12''' shown in the latched state described above. The buckle assembly 12''' is identical in many respects to the buckle assembly 12 illustrated in FIGS. 1-6 and described above, and like numbers are therefore used to identify like components. The buckle assembly 12''' illustratively differs from the buckle assembly 12 in that the base extension 15B''' is substantially shorter than the base extension 15B, and perhaps shorter than the base extension 15B', and in this embodiment the wire or cable portions 26A, 26B are configured as coiled springs. In some embodiments, such coiled springs may be configured to exert a rearward biasing force on the actuating plate 20 which may reduce or enhance the amount of shrinkage required of the wire or cable 26 to actuate the buckle 12'''. Alternatively or additionally, the coiled springs may be configured not to impart significant rearward bias on the plate 20 but rather to shorten the length of the wire or cable 26.

Figure 10:
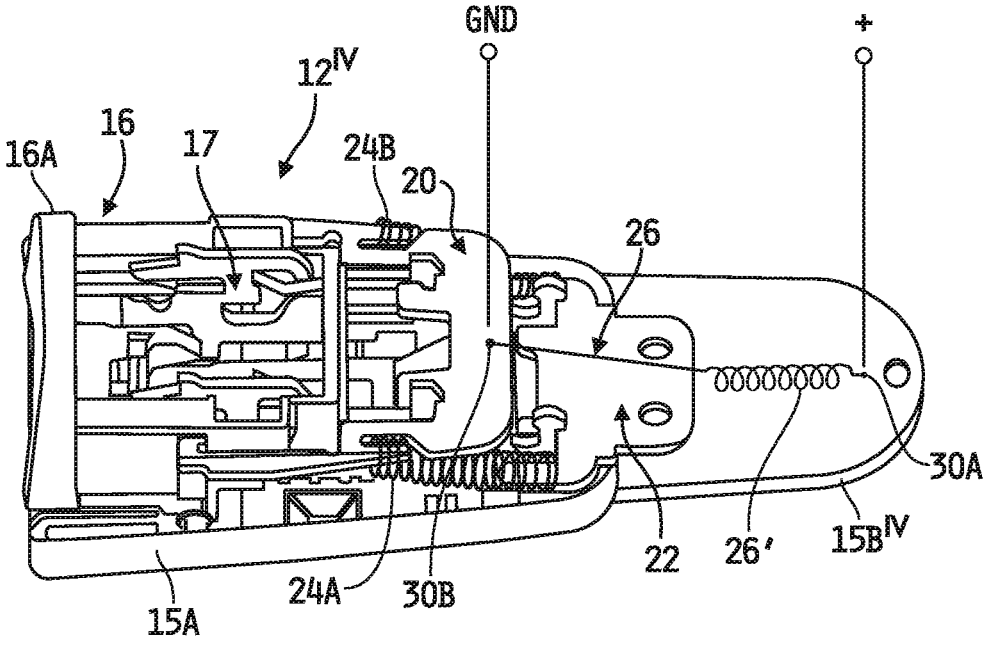
FIG. 10 is a perspective view of a further embodiment of an electrically releasable buckle assembly for a motor vehicle restraint system, with the buckle assembly shown in the latched state.

Referring now to FIG. 10, a further embodiment is shown of an electrically releasable buckle assembly $\mathbf{12}^{IV}$ for a motor vehicle restraint assembly, with the buckle assembly $\mathbf{12}^{IV}$ shown in the latched state described above. The buckle assembly $\mathbf{12}^{IV}$ is identical in many respects to the buckle assembly 12 illustrated in FIGS. 1-6 and described above and also to the buckle assembly 12''' illustrated in FIG. 9 and described above, and like numbers are therefore used to identify like components. The buckle assembly $\mathbf{12}^{IV}$ illustratively differs from the buckle assembly 12''' in that the shape memory alloy wire or cable 26' is illustratively provided in the form of a single length of coiled wire fixed at one end 30A to the base extension $\mathbf{15}B^{IV}$ adjacent to the free end thereof, and fixed at the opposite end 30B to the buckle release actuating plate 20. In the illustrated embodiment, the plate 20, and thus the end 30B of the wire or cable 26', is electrically connected to ground potential, and a positive voltage is applied to the opposite end 30A. In the illustrated embodiment, the length of the base extension $\mathbf{15}B^{IV}$ may be greater or lesser than the base extension 15B'''.

Referring now to FIGS. 11-18, another embodiment is shown of a motor vehicle restraint system including another embodiment of an electrically releasable buckle assembly 100 shown in a latched state with the buckle assembly 100 engaging a conventional tongue assembly 14. In the illustrated embodiment, the buckle assembly 100 includes a conventional release button 106 operatively coupled to a frame 104 of the buckle assembly 100. The release button 106 is movable relative to the frame 104 between a latched position, in which the buckle assembly 100 is engaged with the tongue assembly 14, and a release position which releases the tongue assembly 14 from the buckle assembly 100 in a conventional manner. In the illustrated embodiment, the release button 106 is linearly slidable relative to the frame 104 (e.g., vertically in the orientation depicted in FIG. 11) in a conventional manner between the latched and release positions thereof, although in alternate embodiments the release button 106 may slide non-linearly relative to the frame 104 and/or move or pivot in directions other than that illustrated in FIGS. 11-18. The tongue assembly 14 is illustratively conventional and includes a web engaging body 14A coupled to a rigid tongue member 14B sized and configured to be received within a slot defined through a front nose piece 106A of the release button 106 in a conventional manner as illustrated by example in FIG. 11.

The buckle assembly 100 further illustratively includes conventional tongue latching and release components 108 operatively mounted to the frame 104 and together configured in a conventional manner to cause the tongue 14B to be secured to the buckle assembly 100 in the latched state and to be released from, and in some embodiments expelled from, the buckle assembly 100 in the release state, as described above with respect to embodiment illustrated in FIGS. 1-6.

In the illustrated embodiment, the frame 104 and the release components 108 are mounted in, and carried by, a housing 102. The housing illustratively has a front wall 102A, a rear wall generally 102B and opposing side walls 102C, 102D, all of which define an interior 102E of the housing therebetween in which the frame 104, the release button 106 and the release components 108 are mounted. As best seen in FIGS. 11-14 and 17, the rear wall 102B of the housing 102 illustratively defines a pocket 102F centrally therein that is flanked by rear wall portions 102B1 and 102B2 on either side thereof. The pocket 102F illustratively extends forwardly toward the front wall 102A along opposing, inwardly-facing, inner side walls 102H1 and 102H2, and terminates at an inner rear wall 102G (see, e.g., FIG. 14) spaced apart from the rear wall portions 102B1 and 102B2 by the inner side walls 102H1 and 102H2. A bottom wall 102G covers the bottom side of the housing to define the interior 102E of the housing 10.

In the illustrated embodiment, the buckle assembly 100 includes a release button actuator 110 pivotably coupled to the housing 102, and a coupling bridge 112 coupled to and between the actuator 110 and the release button 106 such that movement, i.e., pivoting, of the actuator 110 moves the release button 106 between the latched and release positions described above via the coupling bridge 112. Shape memory alloy wires or cables 114A, 114B are coupled to the actuator 110 on either side thereof, and each of the wires or cables 114A, 114B extends within and along opposite sides of the housing 102 from the actuator 110 to mounting locations adjacent to the front wall 102A of the housing 102. In the illustrated embodiment, the mounting locations are illustratively provided in the form of electrically conductive fixation elements 116A, 116B, e.g., threaded screws, rivets, or the like, configured to extend into and engage the housing 102 so as to become affixed thereto. The actuator 110 is illustratively likewise electrically conductive, e.g., provided in the form of steel, aluminum or other metallic or otherwise electrically conductive material, so as to establish an electrically conductive circuit path which extends from the fixation elements 116A, 116B, through each of the wires or cables 114A, 114B and through the electrically conductive actuator 110.

Figure 11:
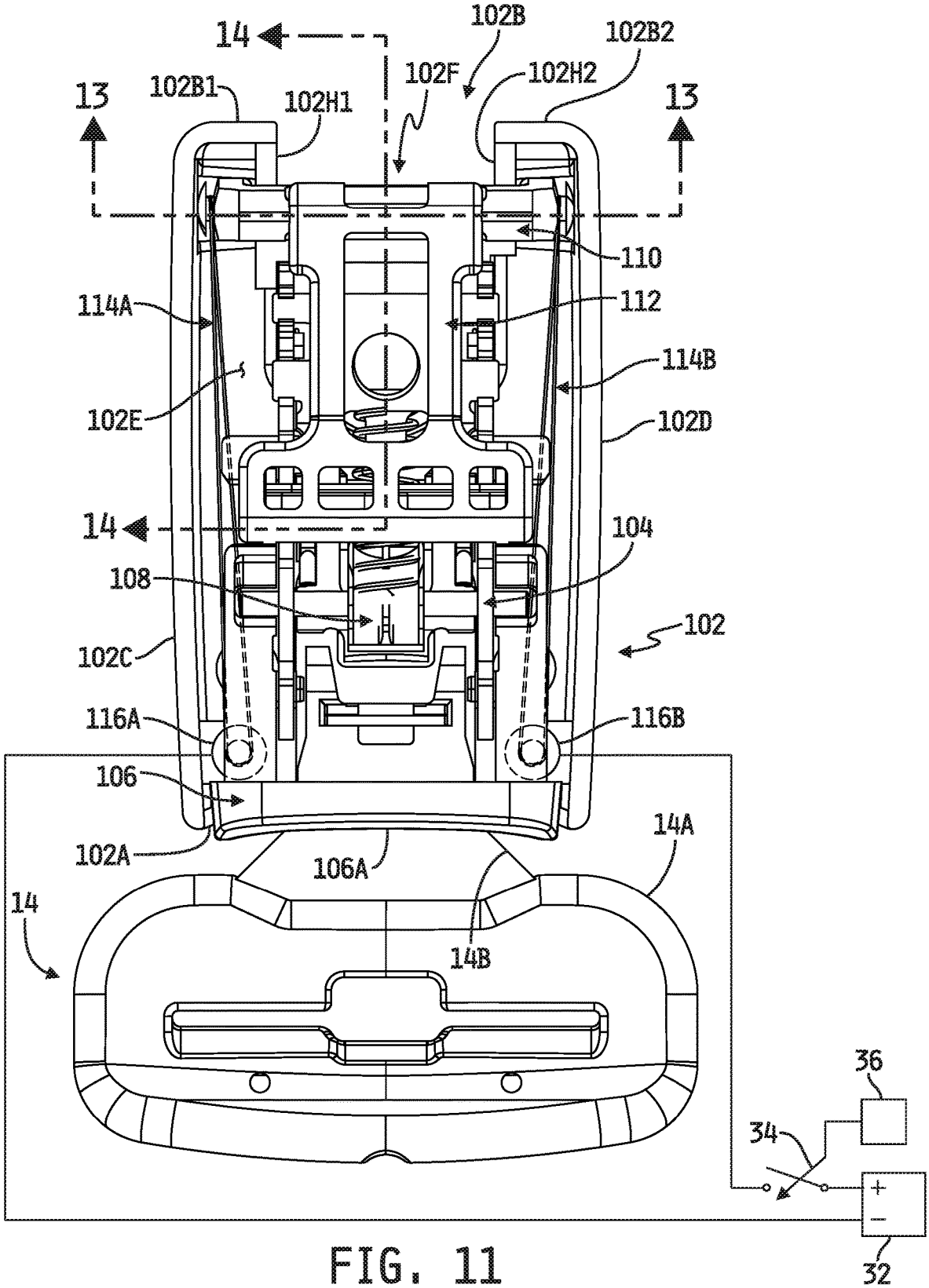
FIG. 11 is a top plan view of another embodiment of a motor vehicle restraint system including another embodiment of an electrically releasable buckle assembly shown in a latched state with the buckle assembly engaging a conventional tongue assembly.
Figure 12:
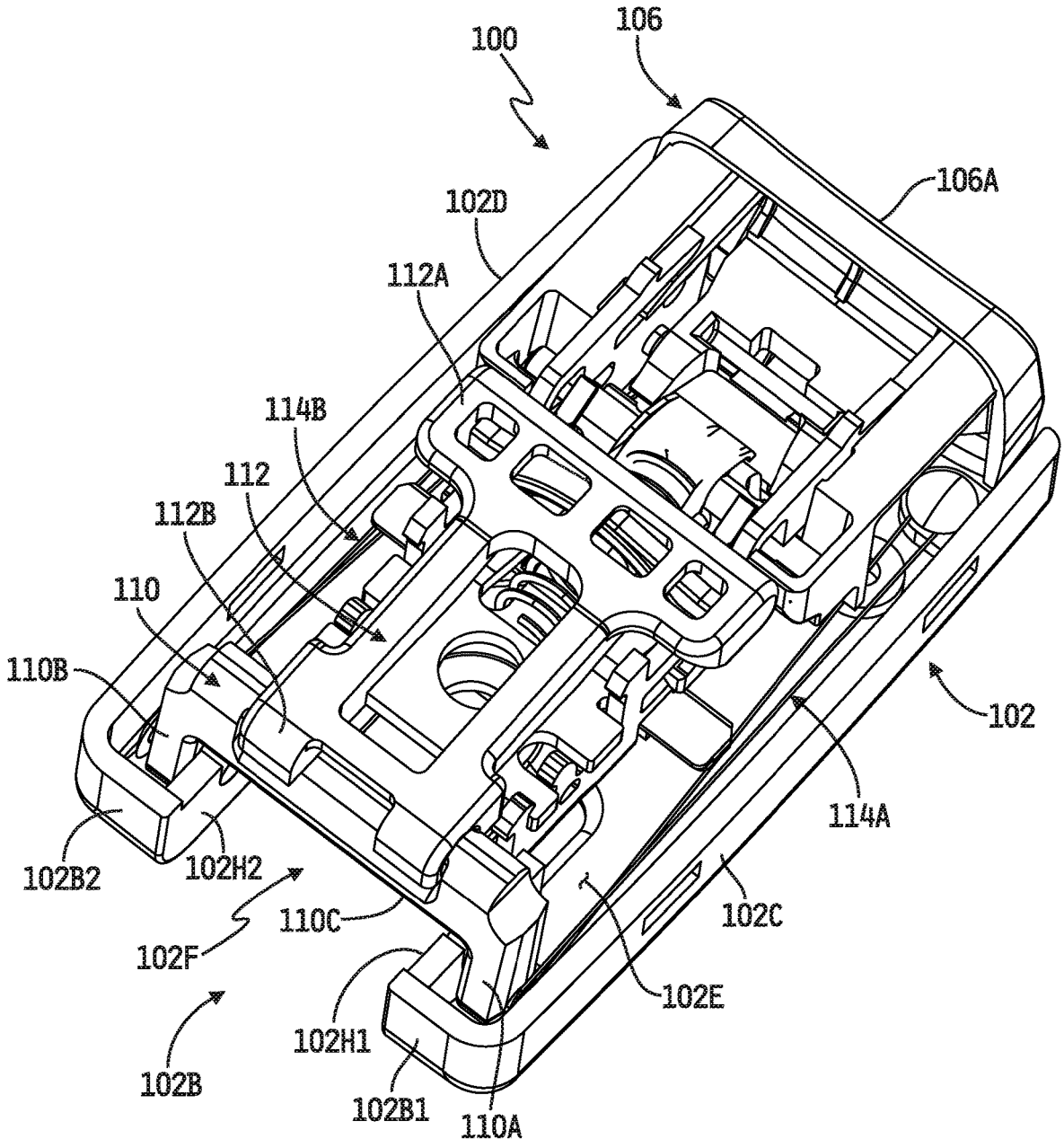
FIG. 12 is a rear perspective view of the electrically releasable buckle assembly of FIG. 11 shown in the latched state.
Figure 15:
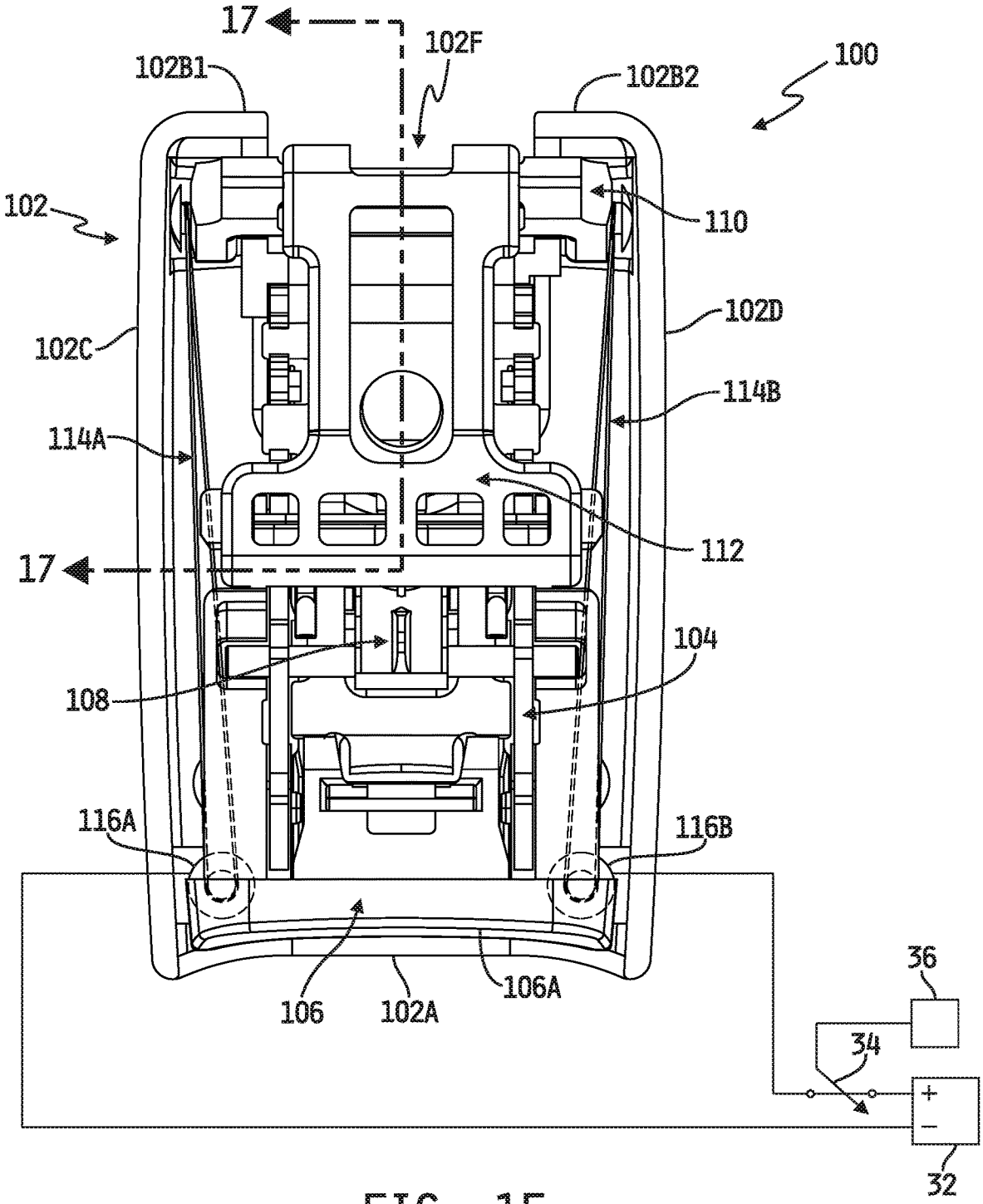
FIG. 15 is a top plan view of the motor vehicle restraint system of FIG. 11 showing the electrically releasable buckle assembly of FIGS. 11-14 electrically actuated, via electrical actuation of a shape memory alloy member operatively coupled to the release button, from the latched state of FIGS. 11-14 to the unlatched or release state in which the tongue assembly is released therefrom.

Similarly as described above with respect to FIGS. 1-4, a source 32 of electrical energy is electrically connected through a switch 34 to the electrically conductive fixation elements 116A, 116B as illustrated by example in FIGS. 11 and 15. In some embodiments, the switch 34 may be a manually activated switch, although in other embodiments the switch 34 may alternatively or additionally be electrically controlled by a control circuit 36, all as described above. The shape memory alloy wires or cables 114A, 1146 are, as described above, illustratively formed of a material which causes its respective lengths to contract or shrink to a shorter length above a transition temperature, and which returns to the pre-contracted or pre-shrunken length below the transition temperature. In one embodiment, for example, the shape memory alloy wires or cables 114A, 114B are formed of a nickel and titanium alloy commercially available as Nitinol® wire, although other material formations of the shape memory alloy wires or cables 114A, 114B are contemplated by this disclosure.

Figure 13:
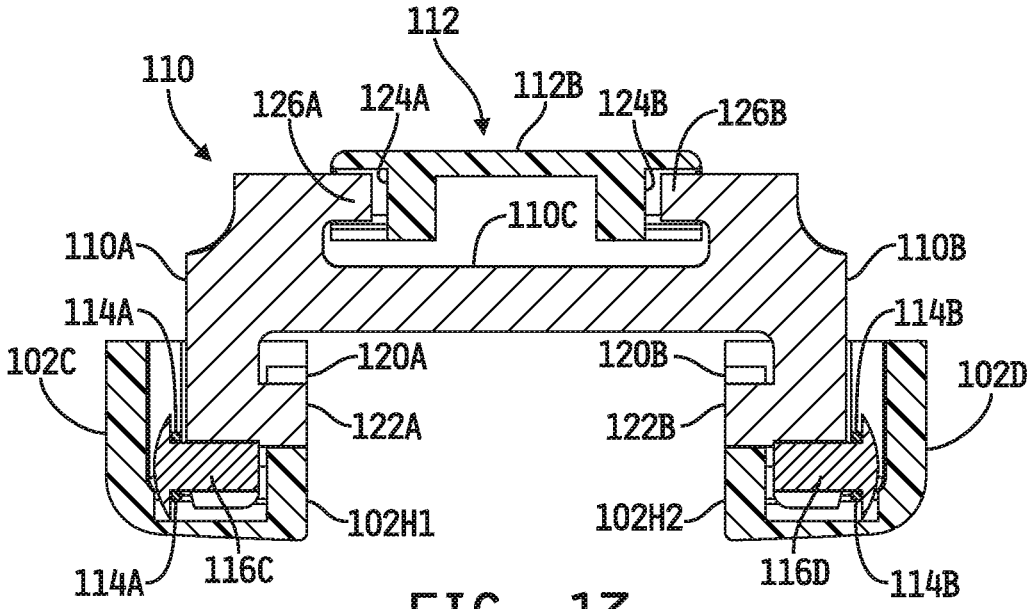
FIG. 13 is a cross-sectional view of a portion of the electrically releasable buckle assembly of FIGS. 11 and 12, as viewed along section lines 13-13 of FIG. 11, with the buckle assembly in the latched state.
Figure 14:
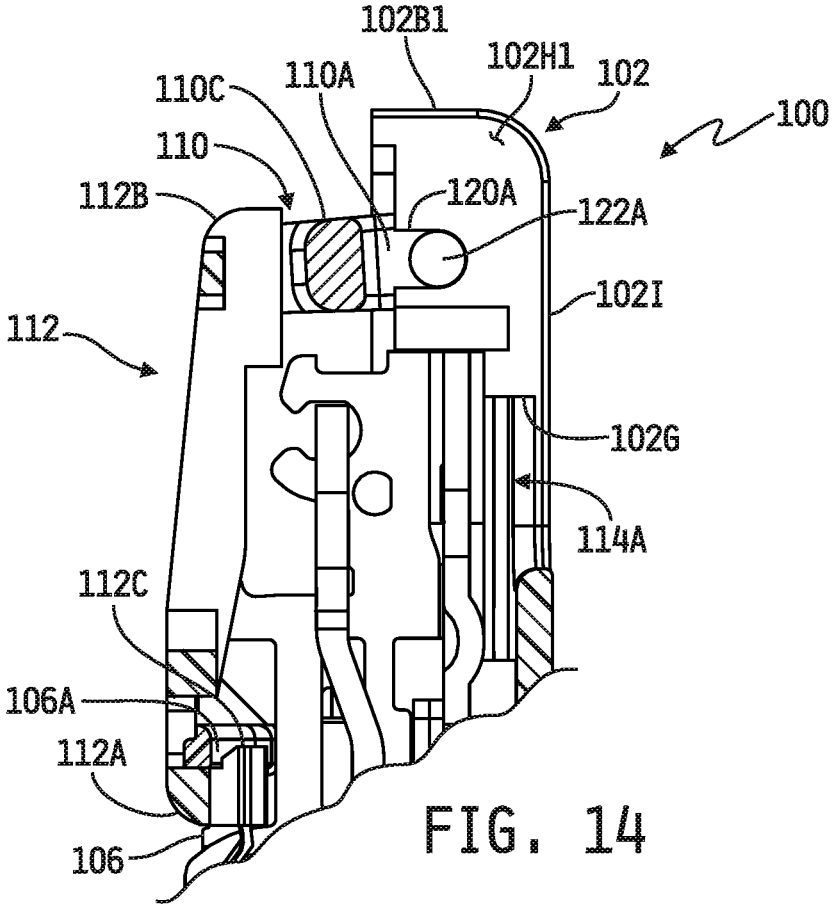
FIG. 14 is a cross-sectional view of another portion of the electrically releasable buckle assembly of FIGS. 11-13, as viewed along section lines 14-14 of FIG. 11, with the buckle assembly in the latched state.
Figure 17:
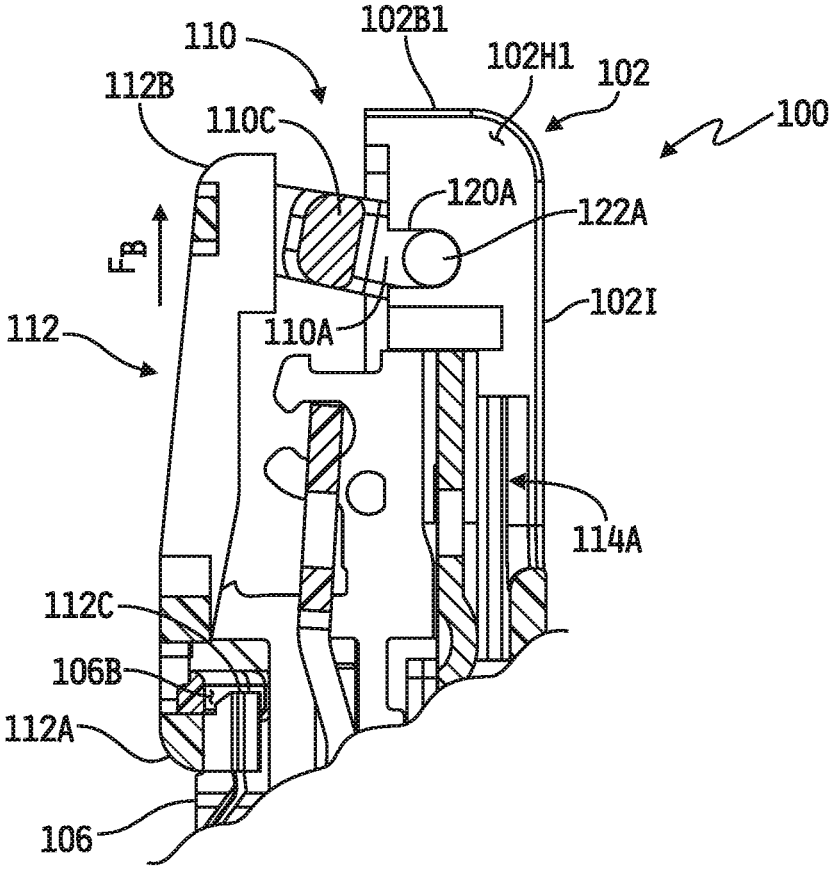
FIG. 17 is a cross-sectional view of a portion of the electrically releasable buckle assembly of FIGS. 15 and 16, as viewed along section lines 17-17 of FIG. 15, with the buckle assembly in the latched state.

Referring now specifically to FIGS. 12-14 and 17, the buckle release actuator 110 illustratively includes a pair of support legs 110A, 1106 each pivotably mounted to the housing 102 near free ends thereof, and joined together at opposite ends thereof by a cross-member 110C. As best illustrated in FIGS. 13, 14 and 17, the inner side walls 102H1, 102H2 each respectively define a vertically-oriented (i.e., generally parallel with the rear wall portions 10261, 102B2) channel or slot 120A, 120B therein sized to receive respective inwardly-facing pins 122A, 122B defined by and extending away from respective legs 110A, 1106 of the actuator 110. With the pins 122A, 122B received within the slots or channels 122A, 122B, the buckle release actuator 110 is pivotable fore and aft relative to the side walls 102H1, 102H2 of the housing 102.

Below the pivot mounting of the buckle release actuator 110, i.e., below the pins 122A, 122B, fixation elements 116C, 116D, e.g., threaded screws, rivets or the like, engage a respective leg 110A, 110B on an outer surface thereof, i.e., on an outwardly-facing surface of each leg 110A, 110B opposite the inwardly-facing surfaces from which the pins 122A, 122B extend. As further depicted by example in FIG. 13, the shape memory alloy wire or cable 114A wraps around the fixation element 116C, and the shape memory alloy wire or cable 114B wraps around the fixation element 116D. In this regard, the shape memory alloy wires or cables 114A, 114B are each illustratively provided in the form of a single length of wire looped about a respective fixation elements 116A, 116B, and the two free ends of the wires or cables 114A, 114B are, in turn affixed to the housing 102 via the respective fixation elements 116A, 116B as described above. In alternate embodiments, the shape memory alloy wires or cables 114A, 114B may include more loops or a single wire or cable each. In any case, the fixation elements 116C, 116D secure the wires or cables 114A, 114B, both mechanically and electrically, to the electrically conductive buckle release actuator 110. In some embodiments, the fixation elements 116A, 116B are provided in the form of threaded screws which may be threaded into the actuator 110 after the wires or cables 114A, 114B are wrapped thereabout to tightly secure the wires or cables 114A, 114B to the actuator 110 and to ensure electrical contact therebetween.

A rear engagement portion 112B of the coupling bridge 112 is coupled to the cross-member 110C of the buckle release actuator 110, and a front engagement portion 112A of the coupling bridge 112 is coupled to a rear portion of the release button 106. Referring specifically to FIG. 13, for example, opposite sides of the rear engagement portion 112B of the coupling bridge 112 define respective channels or slots 124A, 124B therein which are sized to receive respective inwardly-facing pins 126A, 126B defined by the cross-member 110C of the actuator 110. As best shown in FIG. 17, at least one transverse slot or channel 106B is formed in a top side of a rear portion of the release button 106, and at least one toothed protrusion 112C extends downwardly from the front engagement portion 112A of the coupling bridge 112 into the at least one transverse slot or channel 106B to couple the front engagement portion 112A of the coupling bridge 112 to the release button 106. By way of the coupling bridge 112, pivoting movement of the buckle release actuator 110 moves the release button 106 between the latched positon and the release position thereof.

In one embodiment, the release button 106 is formed of a conventional rigid plastic material and the frame 104, the release button actuator 110 and the fixation elements 116A-116D are formed of one or more conventional metals and/or metal composites, although in alternate embodiments the release button 106 and/or the frame 107 may be formed of other conventional materials.

In the example illustrated in FIGS. 11-14, the release button 106 is in its latched position, and the switch 34 is open such that the temperature of the shape memory alloy wires or cables 114A, 114B is below its transition temperature, and thus at their elongated lengths. Under such conditions, one or more biasing members of the tongue latching and release components 108, or one or more other biasing members mounted in and/or carried by the housing 102, bias the release button 106 to the latched position in which the front surface of the nose piece 106A is generally flush with, or extends slightly beyond, the front surface 102A of the housing 102. In this position of the release button 106, the release button actuator 110 is pivoted by the release button 106 acting on the coupling bridge 112, to a forward position best illustrated in FIGS. 12 and 14. In this position of the actuator 110, the shape memory alloy wires or cables 114A, 114B are generally taut, such that the lengths of the wires or cables 114A, 114B between the respective fixation elements 116A, 116C and 116B, 116D are illustratively selected to be substantially equal to the distances between the respective fixation elements 116A, 116C and 116B, 116D under temperature conditions below the transition temperature of the shape memory alloy of the wires or cables 114A, 114B.

Figure 16:
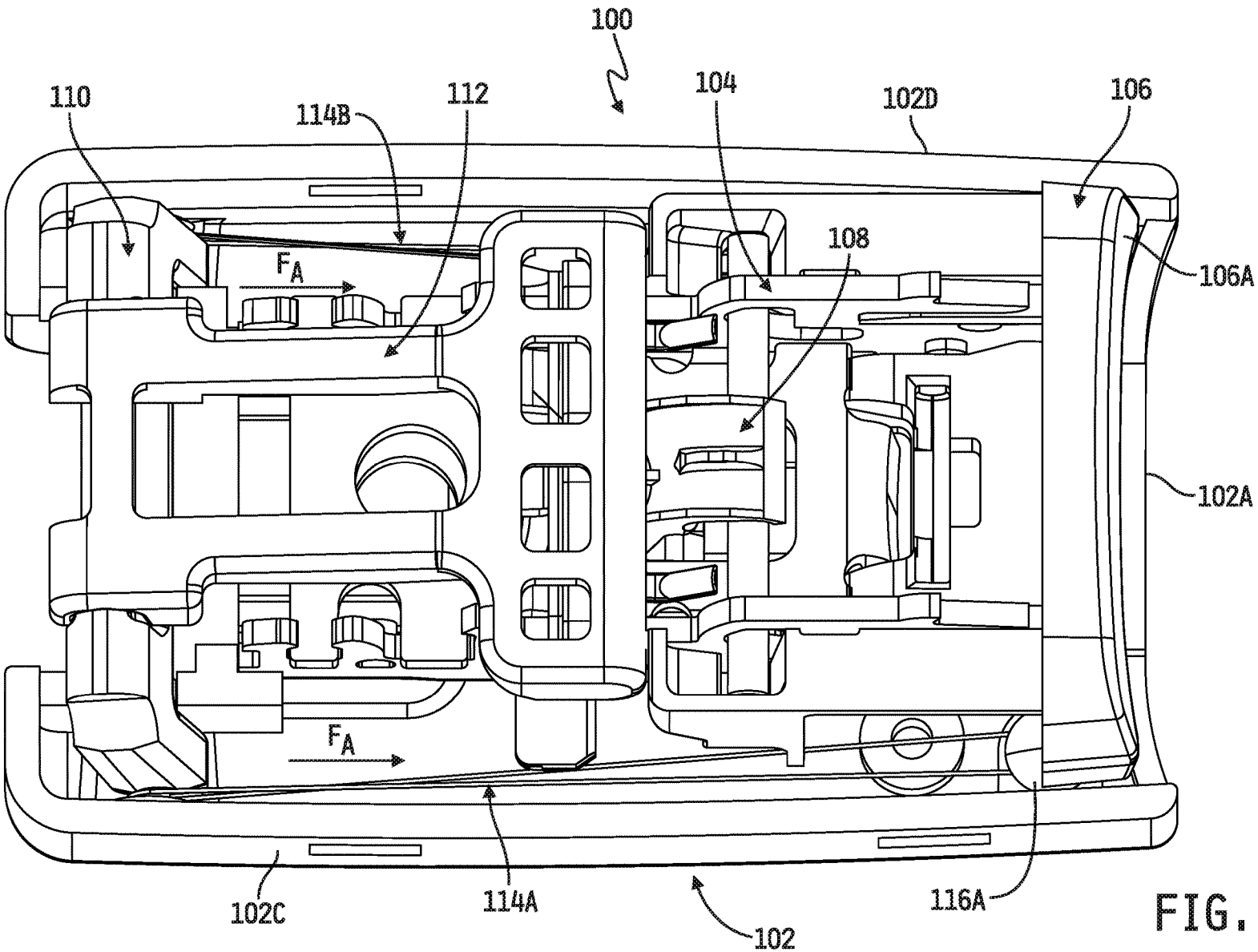
FIG. 16 is a rear perspective view of the electrically releasable buckle assembly of FIG. 15 shown in the electrically unlatched or release state.

In the example illustrated in FIGS. 15-17, the switch 34 is closed, e.g., manually or via the control circuit 36, such that electrical energy is supplied by the source 32 to the shape memory alloy wires or cables 114A, 114B. As electrical current flows from the source 32 through the shape memory alloy wires or cables 114A, 114B, the temperatures of the wires or cables 114A, 114B increase proportionally thereto. The magnitude of the electrical current is illustratively selected to cause the temperature of the shape memory alloy wires or cables 114A, 114B to increase above the transition temperature of the alloy within a selected time period T of closure of the switch 34. In some embodiments, one or more resistors may be suitably connected between the source 32 and the wires or cables 114A, 114B to achieve and/or limit the magnitude of such electrical current. In any case, when the temperatures of the wires or cables 114A, 114B reach and/or exceed the transition temperature of the alloy, the lengths of the wires or cables 114A, 114B shrink as described above. With the wires or cables 114A, 114B affixed to and between the respective fixation elements 116A, 116C and 116B, 116D as described above, such contraction or shrinking of the wires or cables 114A, 114B exerts a forward actuation force $F_A$ on and at the locations of the fixation elements 116C and 116D which, in turn, causes the buckle release actuator 110 to pivot about the pins 122A, 122B relative to the housing 102. Because the pivot pins 122A, 122B of the buckle release actuator 110 are located between the junctions of the legs 110A, 110B with the cross-member 110C and the fixation elements 116B, 116D to which the shape memory alloy wires or cables 114A, 114B are secured, the forward-acting force $F_A$ exerted on the fixation elements 116B, 116D causes the cross-member 110C to pivot rearwardly as illustrated by example in FIG. 17. This reward pivoting of the cross-member 110C, in turn, applies a rearward force $F_B$ to the coupling bridge 112 which, in turn, draws the release button 106 to the release position illustrated by example in FIGS. 15 and 16.

In this embodiment, the buckle release actuator 110 illustratively acts as an amplifier of the shrinkage of the shape memory alloy wires or cables 114A, 114B which allows implementation of shorter-length wires or cables 114A, 114B than would otherwise be required without such amplification. In one illustrative embodiment, which should not be considered to be limiting in any way, the distance between the latched and release positions of the release button 106 is 4.8 mm and the buckle release actuator 110 is illustratively configured, as just described, to amplify the shrinkage of the shape memory alloy wires or cables 114A, 114B by a factor of 1.35. In this example, the shape memory alloy wires or cables 114A, 114B need only shrink, at temperatures above the transition temperature of the alloy, by 3.55 mm. It will be understood that in alternate embodiments, the travel distance between the latched and release positions of the release button 106 may be greater or less than 4.8 mm, the buckle release actuator 110 may be configured to have an amplification factor of greater or less than 1.35, and/or the shape memory alloy wires or cables 114A, 114B may be configured to shrink, at temperatures above the transition temperature of the alloy, by more or less than 3.55 mm, and those skilled in the art will recognize that any modifications required to achieve any such alternate configurations would be a mechanical step for a skilled artisan based on the detailed description herein.

Upon manual or electronic control of the switch 34 to the open position thereof, the temperature of the shape memory alloy wires or cables 114A, 114B will decrease and eventually fall below the transition temperature of the alloy and elongate back to their greater lengths. When this occurs, biasing forces acting on the release button 106 will force the release button 106 forwardly so as to return to its latched position.

Figure 18:
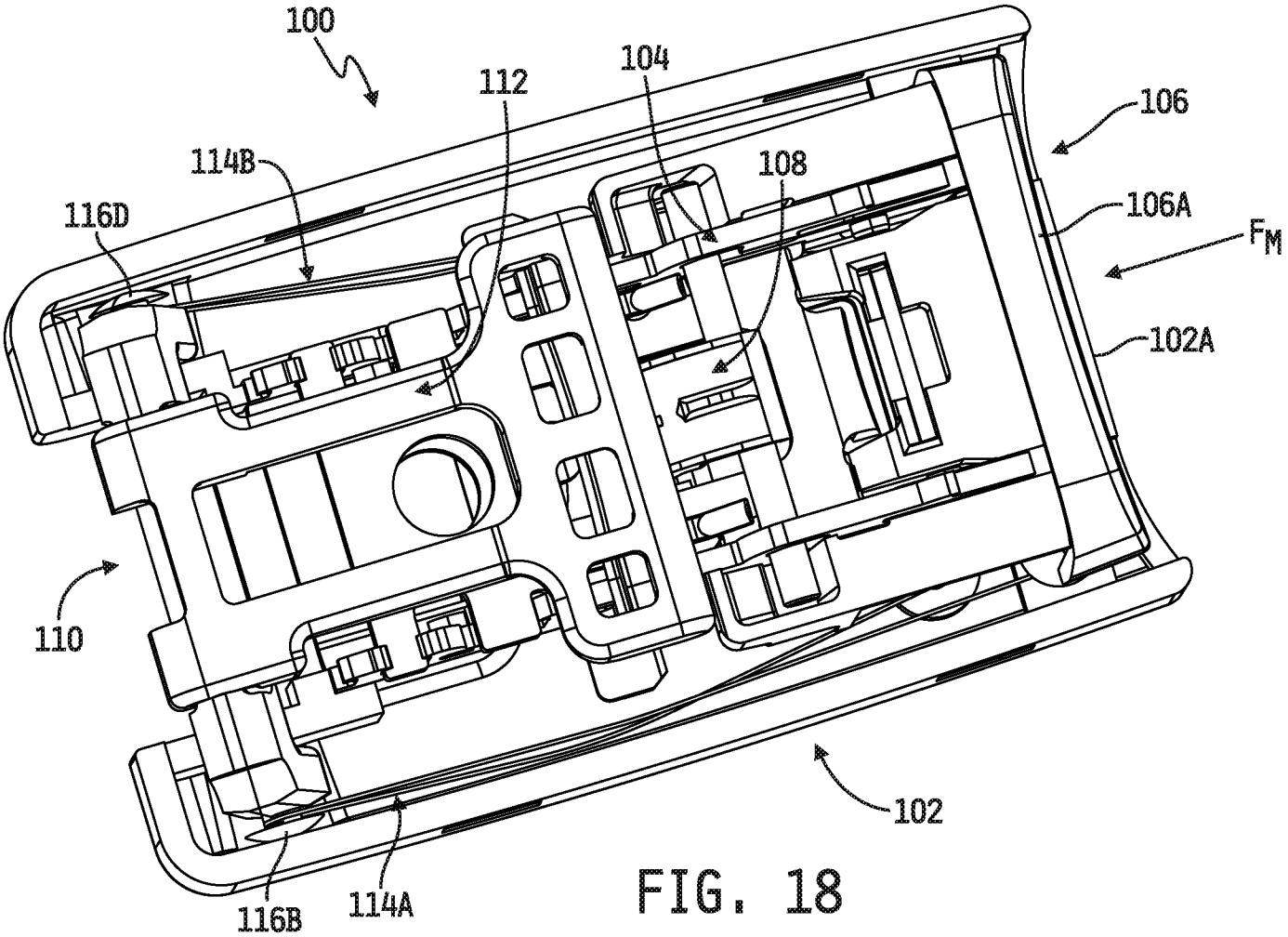
FIG. 18 is a rear perspective view of the electrically releasable buckle assembly of FIGS. 11-17 showing the buckle assembly manually actuated, via manual actuation of the release button, from the latched state of FIGS. 11-14 to an unlatched or release state in which the tongue assembly is released therefrom.

In the example illustrated in FIG. 18, the switch 34 is open such that the temperatures of the shape memory alloy wires or cables 114A, 1146 are maintained below their transition temperature and thus at their elongated lengths. Normally, the release button 106 under such conditions would be in its latched position as depicted by example in FIGS. 11-14. In this example, however, a manual force $F_M$ is applied to the front face of the release button 106 in the rearward direction as illustrated in FIG. 18, sufficient to cause the release button 106 to travel rearwardly, relative to the frame 104 and relative to the housing 102, to its release position described above. As the release button 106 travels rearwardly as just described, the coupling bridge 112 likewise moves rearwardly and acts on the buckle release actuator 110 to pivot the upper portion of the actuator 110 containing the cross-bar 110C rearwardly. This rearward pivoting of the top portion of the actuator 110 causes the portions of the legs 110A, 1106 located below the pivot pins 122A, 122B to pivot forwardly which, in turn, causes the wires or cables 114A, 1146 to flex or bow slightly outwardly (or inwardly) as the fixation members 1166, 116D to which the wires or cables 114A, 1146 are attached also pivot forwardly, all as depicted by example in FIG. 18. When the force $F_M$ is removed from the release button 106, the buckle release actuator 110 is returned by the coupling bridge 112 to its forward position described above with respect to FIGS. 11-14.

While this disclosure has been illustrated and described in detail in the foregoing drawings and description, the same is to be considered as illustrative and not restrictive in character, it being understood that only illustrative embodiments thereof have been shown and described and that all changes and modifications that come within the spirit of this disclosure are desired to be protected. For example, in some embodiments in which application of electrical energy from the energy source 32 to the shape memory alloy component 26, 114A, 114B is controlled by the control circuit 36, the energy source 32 and/or the switch 34 (in embodiments which include the switch 34 separately from the circuit 36) may be controlled by the control circuit 36 to "pre-arm" the shape memory alloy component 26, 114A, 114B for actuation of the buckle release button 16 from its latched position to its release position with a faster response time than without pre-arming the component 26, 114A, 114B. In this example embodiment, the control circuit 36 is illustratively programmed, e.g., via hardware, firmware and/or software, to controllably supply energy, e.g., voltage and current, to the shape memory alloy component 26, 114A, 114B with a programmed or programmable duty cycle so as to pre-heat the shape memory alloy component 26, 114A, 114B to a temperature that is closer to the transition temperature than the ambient temperature. In some such embodiments, the actual temperature of the shape memory alloy component 26, 114A, 1146 may be measured, e.g., using one or more suitable temperature sensors, or predicted based on one or more temperature models, e.g., without directly measuring the operating temperature of the shape memory alloy component 26, 114A, 114B.

What is claimed is:

1. An electrically releasable buckle assembly for a motor vehicle restraint, the buckle assembly comprising:

a housing, latch components mounted in the housing and configured to releasably engage a tongue member of the motor vehicle restraint, a release button carried by the housing and operatively coupled to the latch components, the release button having a latched position in which the latching components engage the tongue member and a release position in which the latch components release the tongue member, a release button actuator having a first end operatively coupled to the release button and a second end opposite the first end, the release button actuator pivotably coupled, between the first and second ends thereof, to the housing, and at least one shape memory alloy component affixed to and between the housing and the second end of the release button actuator, the at least one shape memory alloy component responsive to heating thereof by a source of electrical energy to a temperature at or above a transition temperature to exert a force on the second end of the release button actuator to cause the release button actuator to pivot relative to the housing such that the first end of the release button actuator forces the release button from the latched position to the release position.

2. The buckle assembly of claim 1, wherein the at least one shape memory alloy component includes a first shape memory alloy wire or cable having a first length below the transition temperature and a second length at or above the transition temperature, the second length shorter than the first length, and wherein the first shape memory alloy wire or cable is responsive to the heating thereof to pivot the second end of the release button actuator relative to the housing as the length of the first shape memory alloy wire or cable transitions at or above the transition temperature from the first length to the second length thereof such that the first end of the release button actuator pivots relative to the release button to move the release button from the latched position to the release position thereof.

3. The buckle assembly of claim 2, wherein the release button actuator has two spaced apart legs each having a first end and a second end opposite the first end and each pivotably coupled to the housing between the respective first and second ends, the first ends of the two legs joined together and operatively coupled to the release button, and the first shape memory alloy wire or cable coupled to the second end of the first leg, and wherein the at least one shape memory alloy component includes a second shape memory alloy wire or cable coupled to and between the second end of the second leg and the housing.

4. The buckle assembly of claim 3, wherein the second shape memory alloy wire or cable has a first length below the transition temperature and a second length at or above the transition temperature, the second length of the second shape memory alloy wire or cable shorter than the first length of the second shape memory alloy wire or cable, and wherein the first and second shape memory alloy wires or cables are responsive to the heating thereof to pivot the second ends of the respective first and second legs of the release button actuator relative to the housing as the lengths of the first and second shape memory alloy wires or cables transition at or above the transition temperature from the respective first lengths to the respective second lengths such that the coupled together first ends of the first and second legs of the release button actuator pivot relative to the housing to move the release button from the latched position to the release position thereof.

5. The buckle assembly of claim 4, wherein the first and second shape memory alloy wires or cables are configured to be coupled to the source of electrical energy.

6. The buckle assembly of claim 5, wherein the release button actuator is electrically conductive such that electrical current supplied by the source of electrical energy flows through the first and second shape memory alloy wires or cables and through the release button actuator to heat the first and second shape memory alloy wires or cables.

7. The buckle assembly of claim 1, wherein the source of electrical energy is controlled to pre-heat the at least one shape memory alloy component to a temperature between ambient temperature and the transition temperature so as to pre-arm the at least one shape memory alloy component for actuation of the release button actuator to move the release button from the latched position to the release position with a faster response time than without pre-arming the at least one shape memory alloy component.

8. An electrically releasable buckle assembly for a motor vehicle restraint, the buckle assembly comprising:

a housing, latch components mounted in the housing and configured to releasably engage a tongue member of the motor vehicle restraint, a release button carried by the housing and operatively coupled to the latch components, the release button having a latched position in which the latching components may engage the tongue member and a release position in which the latch components release the tongue member, a release button actuator having a first end operatively coupled to the release button and a second end opposite the first end, the release button actuator pivotably coupled, between the first and second ends thereof, to the housing, and at least one shape memory alloy component affixed to and between the housing and the second end of the release button actuator, the at least one shape memory alloy component responsive to heating thereof to a temperature at or above a transition temperature to shrink so as to exert a force on the second end of the release button actuator and cause the release button actuator to pivot relative to the housing such that the release button actuator forces the release button from the latched position to the release position.

9. The buckle assembly of claim 8, wherein the source of electrical energy is controlled to pre-heat the at least one shape memory alloy component to a temperature between ambient temperature and the transition temperature so as to pre-arm the at least one shape memory alloy component for actuation of the release button actuator to move the release button from the latched position to the release position with a faster response time than without pre-arming the at least one shape memory alloy component.

* * * * *